United States Patent [19]

Stebbins et al.

[11] 4,049,553

[45] Sept. 20, 1977

[54] WATER POLISHING MEANS FOR REMOVING OIL AND OTHER FLOTSAM FROM WATER

[76] Inventors: George B. Stebbins, 938 Fairbrook Lane; James F. Stebbins, 2910 Shakespeare Drive, both of San Marino, Calif. 91108

[21] Appl. No.: 675,733

[22] Filed: Apr. 12, 1976

[51] Int. Cl.[2] ..... B03D 1/26

[52] U.S. Cl. ..... 210/195 R; 210/221 P; 210/540

[58] Field of Search ..... 210/194, 195 R, 195 S, 210/220, 221 M, 221 P, 320, 522, 540, 44

[56] References Cited

U.S. PATENT DOCUMENTS

| | | | |
|---|---|---|---|
| 801,330 | 10/1905 | Moore | 210/540 |
| 1,176,428 | 3/1916 | Callow | 210/221 P X |
| 1,442,306 | 1/1923 | Stonebraker | 210/540 X |
| 2,186,371 | 1/1940 | Durdin, Jr. | 210/44 |
| 2,267,496 | 12/1941 | Ellis et al. | 210/522 X |
| 2,345,426 | 3/1944 | Pruiett et al. | 210/540 X |
| 2,401,745 | 6/1946 | Brown | 210/221 P X |
| 2,948,677 | 8/1960 | Austin et al. | 210/221 P X |
| 3,246,885 | 4/1966 | Stevens | 210/221 P X |
| 3,804,255 | 4/1974 | Speece | 210/194 |

*Primary Examiner*—Wilbur L. Bascomb, Jr.
*Assistant Examiner*—Robert H. Spitzer
*Attorney, Agent, or Firm*—Wills, Green & Mueth Law Corporation

[57] ABSTRACT

Apparatus for removing oil and other flotsam from water, including an elongate tank with an inlet at the upstream end for introducing a fluid and flotsam mixture into the tank to provide a mean fluid level in the tank. A plurality of longitudinally spaced, vertical dams extend transversely across the tank dividing it into longitudinally spaced zones, each of the dams having an upper edge spaced below the mean fluid level in the tank. A vertical weir is provided in each zone extending across the tank so as to divide the zone into an upstream section and a downstream section. Each of the weirs has an upper portion which extends above the mean fluid level and a lower edge spaced above the bottom wall of the tank. The weirs are preferably angularily positioned relative to the longitudinal axis of the tank so as to converge with the side wall of the tank at an acute angle to provide a collecting corner for receiving flotsam. Skimming means are provided at various of the upstream collecting corners to remove the flotsam which collects therein. An open-ended pipe is provided at one or more of the downstream collecting corners, the open end of the pipe being positioned beneath the fluid surface, and pump means are provided to cause a mixture of fluid, flotsam and air to be drawn into the open end of the pipe and to be transported to one or more of the upstream zones and to be dispersed therein for further downstream flow.

6 Claims, 5 Drawing Figures

WATER POLISHING MEANS FOR REMOVING OIL AND OTHER FLOTSAM FROM WATER

BACKGROUND AND BRIEF SUMMARY OF THE INVENTION

This invention relates generally to fluid separators, and more particularly to an improved water polishing apparatus for removing oil and other flotsam from water. Removing oil and other flotsam from water is desirable and/or is required in many situations and for many different reasons. A typical situation is where oil has spilled on a body of water and has created on oil slick. In such situations, the slick and associated water is first removed and the oil is then separated from the water and salvaged or disposed of. In other situations, it might be desirable to remove from water, such flotable or semi-flotable materials as paper fibers, chopped vegetables, wood particles, or meat particles.

The separation of oil from water in which it has been mixed has presented particular problems which the prior art has sought to overcome by means of various special water polishing apparatus. Such apparatus have been characterized by means for directing and controlling the flow of mixed oil and water in predetermined courses which tend to cause the oil and water to separate and which include means for removing the separated oil from the water and for discharging and/or disposing of the oil and the water in some suitable or appropriate manner. Such apparatus have provided means for recirculating the water by being worked upon to extend the period of time it is worked upon in the apparatus and have provided means for aerating the oil and water mixture to enhance the tendency of the oil to rise in and separate from the water. Such apparatus have met with varying degrees of success, but to the best of our knowledge and belief, each is wanting in some material respect which has prevented or inhibited its commercial success.

With the limitations and deficiencies of known apparatus in mind, it is an object of the present invention to provide a water polishing apparatus which is particularly suitable, effective and efficient for removing flotsam from water. More particularly, it is an object to provide such apparatus for removing such materials as oil, paper fibers, wood particles, chopped vegetables and/or meat particles.

A further object is to provide such apparatus which contains novel flow control means for controlling the flow of a mixture of flotsam and water in a manner which is highly effective to cause the flotsam and water to be separate and which includes novel skimming means associated or in combination with the flow control means which is effective to skim flotsam from the surface of the water as it rises to and accumulates on the surface of said water.

Yet another object is to provide such apparatus which includes water recirculating means to recirculate a portion of the water through the apparatus, and novel means for removing or scavenging residual oil and/or mixed oil and water from the surface of the water flowing through the apparatus before it is discharged from the apparatus, for recirculation thereof through the structure for effective separation and removal of said oil.

Another object is to provide scavenging means of the general character referred to above which operates to draw in air and which mixes that air with the water and scavenged oil, preparatory to the recirculation thereof through the structure, whereby a volume of aerated oil and water effective for causing the separation of oil from water is introduced into the normal flow of fluids in the apparatus.

A further object is to provide such an apparatus which includes novel means for effectively distributing the aerated oil and water into the flow of fluid through the apparatus at predetermined spaced locations throughout the flow path of fluids in the apparatus.

Finally, it is an object of the present invention to provide apparatus for removing flotsam from water, which is simple, easy and economical to make, operate and maintain and which is highly effective, dependable and efficient in operation.

We have discovered that the above objects and advantages are achieved by means of an elongate tank with upstream and downstream ends, and an inlet at the upstream end for introducing a fluid and flotsam mixture into the tank to provide a mean fluid level therein. A plurality of longitudinally spaced, vertical dams extend transversally of the tank so as to divide the interior thereof into longitudinally-spaced zones. The dams have upper edges spaced below the mean fluid level in the tank. Each of the upstream zones is provided with a vertical weir which extends across the tank so as to divide the zone into an upstream section and a downstream section. Each weir has an upper portion which extends above the mean fluid level and a lower edge spaced above the bottom wall of the tank. Each of said weirs is preferably angularily positioned relative to the longitudinal axis of the tank whereby to converge with a side wall of the tank at an acute angle to provide a collecting corner for receiving flotsam.

The cross-sectional area of fluid flow over the dam is less than the cross-sectional area of fluid from under the weirs whereby the flow over the dams is more rapid and turbulent than the flow under the weirs.

Skimming means are provided in the collecting corners of the upstream zones, to remove the flotsam from the surface of the fluid in said corners. One or more of the downstream collecting corners contains an open pipe below the surface of the fluid, and pump means are provided to cause a mixture of air, fluid and flotsam to be drawn into the open end of the pipe and be transported to various of the upstream zones for dispersion therein for further downstream flow.

DESCRIPTION OF THE PREFERRED EMBODIMENT

Figures 1, 4, 5:
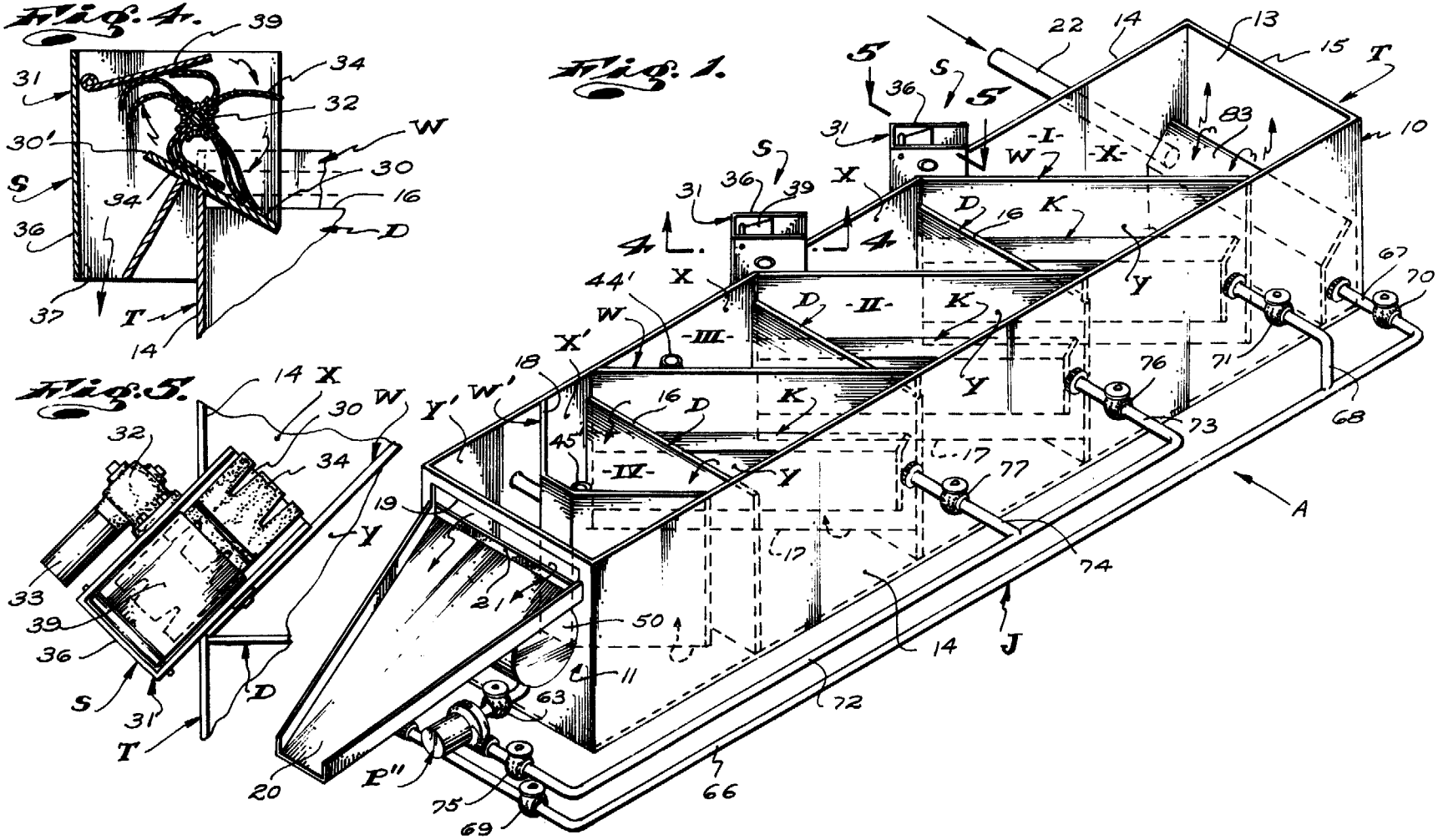
FIG. 1 is a perspective view of apparatus constructed in accordance with the teachings of the present invention.
FIG. 4 is an enlarged vertical sectional view taken substantially as indicated by line 4—4 of FIG. 1.
FIG. 5 is an enlarged top plan view taken substantially as indicated by line 5—5 on FIG. 1.

Referring to the drawings, the water polishing apparatus A which we provide is characterized by an elongate tank T with an upstream or inlet end 10 and a downstream or discharge end 11. The tank T includes a bottom wall 12, an open top 13, vertical side walls 14, and vertical end walls 15. The dimensions and/or proportions of the tank T are determined largely by the environment in which the apparatus is to be used, the volume and nature of material or materials to be worked upon, and other such factors. Accordingly, the size, shape and/or proportioning of the tank is subject to wide variations without departure from the spirit of our invention.

Further, in practice, the tank T can be provided with a top wall or cover (not shown), if desired or if circumstances require.

The tank T next includes means to direct and/or control the flow of fluids therein, which means includes a plurality of longitudinally spaced partitions or dams D in the tank dividing the interior thereof into longitudinally spaced zones, I, II, III and IV. The dams D are in the form of flat vertical plates extending laterally between the side walls 14 of the tank and extending upwardly from the bottom wall 12 to terminate below the top of the tank. The tops of the dams D are defined by straight horizontal upper edges or lips 16 which extend transversely of the interior of the tank on predetermined horizontal planes spaced below the top of the tank. The upper edges or lips 16 of the dams and the adjacent portions of the side walls of the tank define spillways between the noted zones, I, II, III and IV.

Figures 2, 3:
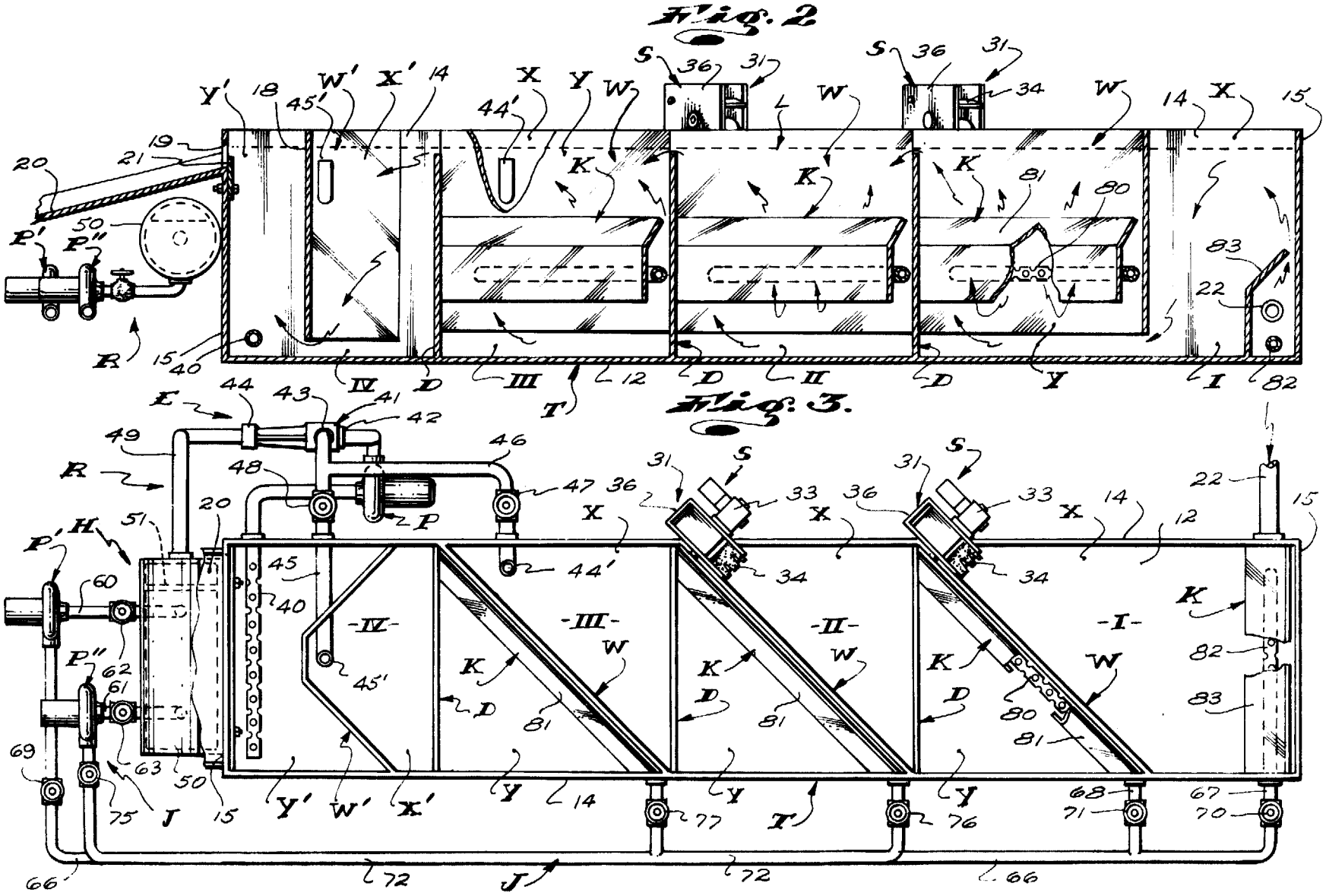
FIG. 2 is a vertical sectional view taken substantially as indicated by line 2—2 on FIG. 1.
FIG. 3 is a top plan view taken substantially as indicated by line 3—3 on FIG. 2.

The vertical placement of the lips 16 is established with reference to a pre-established mean operating fluid level L in the tank (indicated by the longitudinal dotted line in FIG. 2 of the drawings).

The lips 16 of the dams D are preferably arranged below the fluid level L a distance substantially equal to the anticipated thickness of the flotsam which will collect and float on the surface of the water in the several zones of the tank, plus a distance sufficient to conduct that predetermined volume of fluid which is required to carry the flotsam over the dams.

In the form of the invention illustrated, the planes of the dams D are normal to the longitudinal axis of the tank T, whereby the lips 16 are of minimal longitudinal extent and the rate of flow of fluid over the lips or dams is rather rapid. If desired, the dams can be made to occur on planes diagonal or angularly related to the longitudinal axis of the tank so as to increase the longitudinal extent of the lips and to thereby slow the rate at which the fluid flows over the dams. Such control of the rate or velocity of flow over the dams can be of utmost importance in situations where the flotsam is of an unstable nature and where reduction of turbulence at the surface of the water in the tanks is desirable or necessary to maintain the flotsam separate from the water below it.

The apparatus A of our invention next includes weirs W in the zones I, II and III, dividing those zones into upstream and downstream portions or sections X and Y. The weirs W are preferably flat plates arranged to extend diagonally between the side walls 14 and to extend from the top of the tank (from above the water level L) downwardly into the lower portion of the tank.

The weirs W have straight horizontal lower edges 17 which are spaced above the bottom wall of and which cooperate therewith to define lower fluid passages establishing communication between the portions or sections X and Y of the zones I, II and III.

In practice, the edges 17 are spaced a substantially greater distance above the bottom wall 12 than the distance the lips 16 of the dams D are spaced below the liquid level L, whereby fluid in the zones I, II and III flows freely between the sections X and Y of the zones at a very slow rate and in a rather gentle manner so as to generate a minimum amount of turbulence.

To enhance the aforementioned slow, gentle, turbulent-free flow of fluid beneath the weirs W, the weirs are preferably on planes angularly positioned relative to the longitudinal axis of the tanks so as to increase the longitudinal extent of the edges 17 and the fluid openings or passages defined thereby. In the embodiment illustrated, the weirs W are on planes 45° from the central axis of the tank and the lower edges of the weirs are approximately three to eight inches above the bottom wall 14.

In addition to directing and controlling the flow of fluid from sections X to Y of each of the zones I, II and III, as explained above, the upper edge portions of the weirs W also serve to direct oil and flotsam on the surface of fluid in the portion X downstream and laterally into the acute, collector corners defined by the converging weirs and side wall 12, occurring at the upstream sides of the weirs.

Tank T is next characterized by a weir W' in the downstream end zone IV. The weir W' divides zone IV into upstream and downstream sections or portions X' and Y'. The weir W' differs from the weirs W in that it directs the flotsam to the center of the tank, where it is removed and recirculated, as will be described more fully hereinafter.

In the embodiment of the invention illustrated, the weir W' further differs from the weirs W, in that it is substantially V-shaped in plan configuration and is characterized by a pair of flat, vertical, angularly related side portions converging substantially centrally in the zone IV and defining a collector corner or trough in the upstream portion X' of the zone IV.

Finally, the tank T includes an elongate, horizontal, slot-like discharge opening 19 in the downstream end wall 15 of the tank and a discharge trough 20 extending downwardly and longitudinally outwardly or downstream from the opening 19. In practice and as illustrated, a vertically adjustable spill plate or gate 21 is carried by the end wall 15 adjacent the lower portion of the opening 19, and is shiftable vertically to overlie the lower portion of the opening 19 and thereby establish and/or control a desired liquid level in section Y' of zone IV.

With the tank T thus far described, it will be apparent that fluid introduced into the upstream section X of upstream zone I, as by means of a fluid supply pipe 22, first fills the zone I, then flows beneath the weir W therein from section X to section Y. When zone I is filled, the fluid flows over the lip 16 of the dam D between zones I and II, into section X of zone II, beneath weir W therein and into section Y thereof. When zone II is filled, the same flow is repeated with respect to zone III. When zone III is filled, the fluid flows over the downstream dam D into section X' of zone IV, beneath the weir W' therein, into section Y' to fill that zone. When zone IV is filled, the fluid flowing downstream through the tank flows out through the discharge opening 19 and down the trough 20 for suitable use or disposal.

The cross-sectional area of the fluid flow over the dams is less than the cross-sectional area of fluid flow under the weirs, whereby the flow over the dams is faster than the flow under the weirs. Accordingly, the downward flow in the upstream sections X and X' of the several zones, beneath the weirs therein and upward in the sections Y of those zones is slow, gentle and relatively free of turbulence, while horizontal downstream flow over the dams and from the sections Y to the sections X of adjacent zones is relatively rapid and forceful.

While the use of our apparatus is not limited to separating oil from water, we will, for the sake of brevity, restrict the discription to such limited, specific use.

With the above in mind, it will be apparent that when a mixture of oil and water is circulated downstream through the tank T, oil floating to the top of the water in the upstream section of each zone in the tank is stopped from flowing downstream in the tank by the upper dam-like portion of the weirs W and is directed and crowded or confined into the collecting corners defined by the weirs, for ready and easy collection and removal. The water which is in the cleanest or most oil-free and therefrom the heaviest, drops to the bottom of the section X of the several zones in the tank, flows slowly under the weirs in said zones, and into and thence upwardly in the section Y of the zones. As such flow through the several zones and from zone to zone takes place, the major part of the oil carried by the water is effectively separated from the water. The rapid, increased or accelerated flow of water across the upper edges of the dams D is effective to flush and direct oil on the surface of the water downstream of the dams, toward the weirs and to urge and carry it into the collecting corners established by the weirs. Further, as a result of the greater surface tension of the oil on the surface of the water in the section X of the several zones in the tank, increased rate of flow across the dam serves to tow or draw the oil on the water's surface upstream of the dams across the dams and onto the surface of the water downstream of the dams.

The apparatus which we provide, next includes skimming means S associated with the tank T at the collecting corners established by the weirs W in the zones I and II and adapted to continuously remove oil from the surface of the water in said collecting corners, and to discharge that oil into receptacles for salvage or disposal.

The skimming means S associated with each of zones I and II, comprises an outwardly and upwardly inclined ramp (FIG. 4) extending through a notch in the side walls 15 of the tank. The ramp has an inner lower end portion 30 extending into the oil and water in said collecting corner, and an outer end portion 30' projecting outwardly and freely from the side of the tank.

The means S next includes a rotary wiper assembly 31 adapted to engage and wipe oil above the inner end portion of the ramp 30, longitudinally outwardly along and thence from the outer end of the ramp. The wiper assembly 31 includes a shaft 32 rotatably mounted above the ramp, a prime mover 33 in the form of a gear reduced electric motor rotating the shaft, and a plurality of circumferentially spaced radially outwardly extending flexible wiper blades or flaps 34 carried by the shaft and engageable with the ramp to establish intermittent longitudinal wiping engagement therewith, as the shaft is rotated. In practice, the wiper flaps 34 are flexible neoprene impregnated fabric. The flaps can be suitably notched or bifurcated and can, as shown, be advantageously provided in independently flexible pairs so as to increase the capacity of the wiper assembly to move oil along the ramp 30. Also, there can by any number of such flaps, depending upon the flotsam being removed.

In practice, the wiper assembly 31 includes a suitable frame or housing 36 enclosing the ramp, and defining a discharge chute 37 at the outer end of the ramp and through which oil drops into some suitable collecting means (not shown).

A suitable wiper or stripper means such as a flap engaging plate 39 can be carried by the frame 36 to effectively wipe or strip oil from the flaps 34 as the flaps are advanced in their circular travel path by the prime mover.

The prime mover 33 of the wiper assembly 31 is such that the rate of rotation of the shaft and flaps can be varied as desired. In practice, it has been found that rotating the shaft and flaps at the rate of from two to four rpm is generally most effective.

The apparatus of the present invention next includes recirculating means R (FIG. 3) which functions to remove a predetermined amount of water from zone IV and volumes of oil, water and air from the surface of the water in zones III and IV, and to then aerate and mix said water, oil and air and introduce the mixture into zones I and II of the tank T for recirculation through the apparatus.

The recirculating means includes extracting means E, mixing and holding means H, delivery means J and distribution means K. (FIG. 3).

The extracting means E includes a motor driven centrifugal primary pump P, the inlet side of which is connected with a perforated drainpipe 40 preferably positioned at the bottom of section Y' of zone IV and which operates to continuously draw off a portion of the water in section Y' of zone IV for recirculation. Under some conditions, it might be advisable to have the drainpipe 40 in others of the zones. The means R next includes an ejector 41 having a fluid inlet 42 which is connected with the discharge side of the pump P, a suction inlet 43, and a discharge end 44. The suction inlet 43 of the ejector connects with scaventing pipes 45 and 46 which extend into the zones III and IV of the tank, and which have upwardly opening ends 45' and 44' which are positioned in the collecting corners established by the weirs W and W', at or just slightly below the surface of the water in the said corners and on which the oil to be removed is floating. Suitable manually operable flow control valves 47 and 48 are provided in the pipes 45 and 46 so that the volume of oil, water and air drawn through the ejector 41 can be controlled.

The discharge end 44 of the ejector 41 is connected with the holding and mixing means H through a delivery pipe 49. The holding means H comprises a holding tank 50 with a diffusion plate or baffle 51 therein. The delivery pipe 49 delivers water, air and oil discharged by the ejector 41 into the tank 50, where it is directed to impinge upon the diffusion plate 51 in the tank so as to assure substantial complete mixing of the oil, air and water.

It is to be noted that the ejector 41 operates to aerate the oil and water flowing therethrough. However, due to the fact that the relative volumes of air, water and oil being drawn into the ejector through the scavening pipes 44 and 45 are subject to constant and considerable variations, it is desirable that the holding and mixing means H be provided to compensate for such variations and to assure delivery of a more uniform blend of aerated oil and water into the tank T.

The delivery means J can include a single delivery pump connected with and drawing aerated oil and water mixture from the tank 50, but in practice, it preferably includes a pair of delivery pumps P' and P'', the inlets of which are connected with the tank 50 of means H by suctions lines 60 and 61. Suitable manually operable control valves 62 and 63 are provided in the suction lines.

The outlet of the pump P' is connected with a log pipe 66 which extends to the upstream end of the tank T and connects with branch pipes 67 and 68 communicating with the distributing means K and K' in zone I of the tank. The pipe 66 and the branch pipes 67 and 68 have manually operable flow control valves 69, 70 and 71 positioned therein. In some situations, it is preferable to have only the log pipe 66 and the one branch pipe 67.

The discharge side of pump P'' is connected with a log pipe 72 which extends to the portion of the tank defining zones II and III and connects with branch pipes 73 and 74 communicating with distributing means K in zones II and III. The pipe 72 and branch pipes 73 and 74 have manually operable flow control valves 75, 76 and 77 engaged therein.

The distributing means K that we provide serves to distribute the aerated mixture of water and oil to the sections Y of zones I, II and III, uniformly and substantially free of turbulence. The means K includes elongate perforated distributor pipes 80 connected with the branch pipes 68, 73 and 74 of the distributing means J, and extend horizontally, in close spaced relationship with the lower portion of the weirs W, at the downstream sides or surfaces thereof. The means K further includes diffusion plates 81 overlying the top and downstream sides of the pipes 80, in spaced relationship therewith and spaced from the weirs and the bottom wall of the tank so that directional flow of fluid from the pipes 80 is interrupted by the plates and said fluid is caused to gently flow and combine with the normal flow of fluids in the tanks at and throughout the bottom surface of the zones Y and upwardly across and throughout the downstream sides or surfaces of the weirs W.

The distributor means K' in zone I comprises a perforated distributor pipe 82 (FIG. 3) which extends horizontally across the lower portion of the end wall 15 of the tank T in close spaced relationship with the downstream side of said wall. A transversely and vertically extending diffusion plate 83 extends up from the bottom of the tank and is formed to extend rearwardly toward the rear wall 15 in spaced relationship above the pipe 82, and to terminate in spaced relationship from the rear wall of the tank, whereby the aerated mixture of water and oil delivered into zone I is closed to flow upwardly and uniformly across the rear wall 15 of the tank to combine with fluid in the tank in a gentle, non-turbulent manner.

The reason for aerating and recirculating oil and water extracted from the downstream end of the tank T resides in the fact that aeration and mixing of an oil and water mixture greatly increases the tendency of oil to separate from and rise to the surface of the water.

To further increase the effectiveness of the apparatus, a water/oil mixture can be withdrawn from below the diffusion plate 83 in zone I as by means of a perforated drainpipe like 40, the fluid aerated as with an ejector like 41, and the aerated mixture returned to zone I below the diffusion plate 83 as with a perforated distributor pipe like 82.

We claim:

1. Water polishing apparatus, comprising:

an elongate tank with upstream and downstream ends, opposed side walls, and a bottom wall;

an inlet at the upstream end of the tank for introducing a fluid and flotsam mixture into the tank to provide a mean fluid level in the upper portion thereof;

a fluid outlet at the downstream end of the tank;

a plurality of longitudinally spaced, vertical dams extending transversely of the tank and dividing it into longitudinallyspaced zones, said dams having upper, substantially horizontal edges spaced below the mean fluid level in the tank;

a vertical weir in each zone extending from one side wall to the other and dividing the zones into upstream and downstream sections, each of said weirs having an upper portion projecting above the mean fluid level in the tank, and a lower edge spaced above the bottom wall, said weir being angularily positioned relative to the longitudinal axis of the tank and converging with a side wall at an acute angle to provide a collecting corner at the upstream side of the weir for receiving flotsam;

skimming means at at least one of said collecting corners for removing flotsam from the surface of the fluid;

scavenging means at one of the collecting corners downstream of a zone containing skimming means, for removing fluid and flotsam from the fluid surface, and including at least one pipe having an open upper end beneath the upper surface of the fluid in the tank, a fluid storage container, and first pump means between said pipe and the storage container for causing a mixture of air fluid and flotsam to flow from the fluid surface to the storage container; and a delivery system between the storage container and at least one of the zones for transporting said mixture to said zone for dispersion therein.

2. Water polishing apparatus according to claim 1, which includes:

an auxiliary zone downstream of the zones containing angularily positioned weirs;

a vertically-extending, generally v-shaped weir positioned in said auxiliary zone and containing an upper edge spaced below the mean fluid level in the tank and a lower edge spaced above the bottom wall of the tank; and auxiliary scavenging means within said v-shaped weir for removing fluid and flotsam from the fluid surface in said auxiliary zone.

3. Water polishing apparatus according to claim 2 in which each of the scavenging means and the auxiliary scavenging means includes a pipe having an open upper end beneath the upper surface of the liquid in the tank and a lower end, and which further includes:

an inlet and an outlet at said first pump means;

conduit means interconnecting the inlet of the first pump means with the lower ends of said pipes;

conduit means interconnecting the outlet of said first pump means with the fluid storage container;

second pump means having an inlet and an outlet;

conduit means interconnecting the inlet of the second pump means with said fluid storage container; and distribution conduit means interconnecting the outlet of said second pump means with at least one of said zones.

4. Water polishing apparatus according to claim 3, in which said distribution conduit means interconnects the outlet of the second pump means with the downstream sections of all zones other than the auxiliary zone.

5. Water polishing apparatus according to claim 1, in which the delivery system includes: a perforated distributor pipe extending across the lower portion of the downstream side of the weir in the zone into which the mixture is to be dispersed; and a deflector plate in spaced relationship with and overlying the upper and downstream sides of the distributor pipe.

6. Water polishing apparatus according to claim 1, in which the skimming means includes:

an inwardly and downwardly inclined ramp supported on the tank, with the inner end thereof extending into the fluid and the outer end terminating outwardly of the tank; and wiper means including a motor driven shaft positioned above the ramp and carrying thereon a plurality of radially extending flexible flaps for sequentially engaging and advancing laterally outwardly along the ramp as the shaft is rotated, to engage flotsam on the surface of the fluid and advance it along the ramp from the inner end to the outer end thereof.

* * * * *